US012298113B2

(12) United States Patent
Bower et al.

(10) Patent No.: US 12,298,113 B2
(45) Date of Patent: May 13, 2025

(54) PROJECTILE TARGET FOR ARCHERY PRACTICE

(71) Applicants: James Bower, Gobles, MI (US); Thomas J. Mejeur, Paw Paw, MI (US)

(72) Inventors: James Bower, Gobles, MI (US); Thomas J. Mejeur, Paw Paw, MI (US)

( * ) Notice: Subject to any disclaimer, the term of this patent is extended or adjusted under 35 U.S.C. 154(b) by 0 days.

(21) Appl. No.: 17/360,967

(22) Filed: Jun. 28, 2021

(65) Prior Publication Data

US 2022/0090883 A1 Mar. 24, 2022

Related U.S. Application Data

(60) Provisional application No. 62/705,420, filed on Jun. 26, 2020.

(51) Int. Cl.
*F41J 3/00* (2006.01)

(52) U.S. Cl.
CPC ..... *F41J 3/0004* (2013.01)

(58) Field of Classification Search
CPC ..... F41J 3/0004; B32B 5/12
See application file for complete search history.

(56) References Cited

U.S. PATENT DOCUMENTS 2,812,947 A * 11/1957 Fatzinger ..... F41J 3/0004 D11/158
3,367,660 A * 2/1968 Di Maggio ..... F41J 3/0004 273/404
3,476,390 A * 11/1969 Roloff ..... A63F 9/0204 273/404
3,480,273 A * 11/1969 Wise ..... A63B 63/00 482/16
3,762,709 A * 10/1973 Roloff ..... F41J 3/0004 273/404
4,066,261 A 1/1978 Stewart
(Continued)

FOREIGN PATENT DOCUMENTS

GB 2 403 161 A 12/2004

OTHER PUBLICATIONS

Guarav Nilakantan and Steven Nutt, "Effects of ply orientation and material on the ballistic impact behavior of multilayer plain-weave aramid fabric targets," Defence Technology, vol. 14, issue 3, Jun. 2018, p. 165-178 (Year: 2018).*

*Primary Examiner* — Melba Bumgarner
*Assistant Examiner* — Amir A Klayman
(74) *Attorney, Agent, or Firm* — Mark L. Maki; Miller Canfield

(57) ABSTRACT

A projectile target preferably for archery practice is provided, which includes an improved construction for assembling the target and capturing arrows and other similar projectiles while preventing the arrows and similar projectiles from penetrating entirely through the target and projecting through or exiting the opposite side of the target. The target may be provided in a two-sided configuration with target patterns on both opposite faces of the target body. The main target body preferably is formed of a layered construction with at least first and second target layers which are joined in facing relation to form the main target body. The first and second target layers form first and second halves of the main body, which are joined together in facing relation to define a central plane in which a puncture resistant middle layer section is formed.

14 Claims, 6 Drawing Sheets

(56) References Cited

U.S. PATENT DOCUMENTS

| | | | | | |
|---|---|---|---|---|---|
| 4,076,246 | A | | 2/1978 | Meyer | |
| 4,695,060 | A | * | 9/1987 | Pilgrim | F41J 3/0004 273/404 |
| 5,002,285 | A | * | 3/1991 | Morrell | F41J 3/0004 273/408 |
| 5,354,066 | A | * | 10/1994 | Swanson | F41J 3/0004 273/408 |
| 5,498,001 | A | * | 3/1996 | Franks | F41J 3/0004 273/403 |
| 5,503,403 | A | * | 4/1996 | Morrell | F41J 3/0004 273/408 |

* cited by examiner

PROJECTILE TARGET FOR ARCHERY PRACTICE

CROSS REFERENCE TO RELATED APPLICATIONS

This application claims priority from U.S. Provisional Patent Application No. 62/705,420, filed Jun. 26, 2020, the disclosure of which is incorporated herein by reference in its entirety.

FIELD OF THE INVENTION

The invention relates to a projectile target for archery practice, and more particularly, to a target having penetration resistant interior layers to prevent penetration of arrows and the like through the target thickness.

BACKGROUND OF THE INVENTION

In a prior target construction, a target included a hand painted target on a large piece of foam, which provided suitable enjoyment for practicing, but this target construction did not stop arrows from passing thru the target. In another design, two pieces of foam were adhered together. This added thickness helped in slowing down the arrow, but the arrow would still exit or poke thru the opposing side of the target, which marred the opposite side of the target so that the target was essentially a one-sided target.

There is a need for improved targets having greater durability.

SUMMARY OF THE INVENTION

The invention relates to a projectile target preferably for archery practice, which includes an improved construction for assembling the target and capturing arrows and other similar projectiles while preventing the arrows and similar projectiles from penetrating entirely through the target and projecting through or exiting the opposite side of the target. The arrows and bolts are types of shafted projectiles that have an elongate shaft and are projected by bows and/or crossbows at a relatively low energy in comparison to bullets, which are explosively driven at a high energy. These shafted projectiles can be fired at different velocities depending upon the equipment being used, which may include bows, whether compound bows, long bows, or cross bows or any other similar equipment for shooting these types of projectiles. When fired at a practice target, such shafted projectiles preferably only penetrate partially into the target with the tail end of the shaft projecting from the target face for easy removal.

The invention relates to an improved target construction, which preferably may be provided in a two-sided configuration with target patterns on both opposite faces of the target body. The main target body preferably is formed of a layered construction with at least first and second target layers which are joined in facing relation to form the main target body. Generally, the thickness of each target layer is relatively wide and a fraction of the total thickness of the main body. Generally, the first and second target layers form first and second halves of the main body, which are joined together in facing relation to define a central plane in which a puncture resistant middle layer section is formed.

Each target layer offers sufficient rigidity and stability for the arrow to strike and puncture the target face and allow the arrow or other shafted projectile to partially embed itself in the target layer with a tail portion of the projectile shaft projecting out of the target face. If the projectile enters at a lower velocity, the projectile may not have enough energy to fully puncture the entire thickness of one target layer. However, these shafted projectiles typically are fired at velocities that are more than adequate to puncture a single target layer and possibly more than one target layer so as to pass through the target. In the inventive target, however, the middle layer section of the target 10 defines a puncture resistant or puncture proof layer formed of relatively thin flexible sheets such as puncture resistant fabrics that preferably are stretchable along the plane or surface of the fabric. The present invention preferably comprises at least two interior layers or sheets of a puncture resistant fabric that may be formed of ultra-high-molecular-weight polyethylene (UHMWPE) although other puncture resistant sheet materials are suitable for use in place of this preferred fabric or in different combinations of fabric materials. The interior layers of puncture resistant fabric are sandwiched between the first target layer and a second target layer that forms the opposite side of the main body.

Preferably, the puncture resistant material of each interior layer is not secured to the foam target layers except about the perimeter of the target layers and the interior layers so that the interior layers comprise an unsecured central area or central portion and a secured outer periphery. Securing of the outer periphery may be accomplished by bonding with a bonding material, anchoring within a securing groove or mechanically fastened or through other suitable means which secures the outer periphery in place relative to the central area so that the central area preferably is unsecured over all or most of the central area.

The interior layer material is formed of a puncture resistant material, which impedes the arrow as it travels through the foam material of the facing target layer and attempts to penetrate into the adjacent target layer. This interior layer materials has sufficient puncture resistance to reduce the kinetic force of the arrow to a level that may allow continued piercing of the interior layers but no or only limited piercing of the back target layer through a partial thickness thereof so as to prevent the arrow from completely penetrating the target. Since the central area of the interior layers preferably is not adhered and may have some stretchability, this deformation of the interior layers may also help reduce the kinetic energy of the arrow acting transverse to the plane of the puncture resistant interior layers. As the arrow tip contacts the fabric, the fabric can stretch along its surface and deform into the back target layer, preferably without puncturing or piercing the fabric. As such, the fabric is stretched across its face plane and deforms for each shot. While the fabric may remain deformed after the arrow is removed, shooting of an arrow at a different spot or from the opposite target side may again stretch the fabric near the arrow tip while pulling and flattening the fabric in the area of the prior arrow strike. As such, the fabric remains unpierced and recovers its shape with subsequent arrow strikes to the point that the vinyl target sheets might be completely used up and replaced, while the interior layers of fabric retain their integrity and are able to continue stopping or catching the arrow or projectile.

To further increase the total puncture resistance of the middle layer sections, a plurality of puncture resistant interior layer materials may be provided with each layer having respective unsecured central portions. Further, the puncture resistant fabrics may have a weave that results in different performance in different transverse directions across the fabric face. In other words, the fabric may have a bi-directional weave direction extending across the fabric face. The present invention therefore may orient each fabric layer with the respective weave directions oriented perpendicular to each other or more preferably at an angle relative to each other. For example, one fabric layer may have the weave generally parallel to the target edges and the next adjacent layer oriented at an angle such as 45 degrees relative to the adjacent layer to thereby increase the puncture resistance.

The present invention thereby provides an improved target such as for archery which is configured to prevent penetration of the arrow or other similar projectile through the entirety of the target. This allows one side of the target to be used for target practice while preserving the other side for later target practice.

Other objects and purposes of the invention, and variations thereof, will be apparent upon reading the following specification and inspecting the accompanying drawings.

Figure 1:
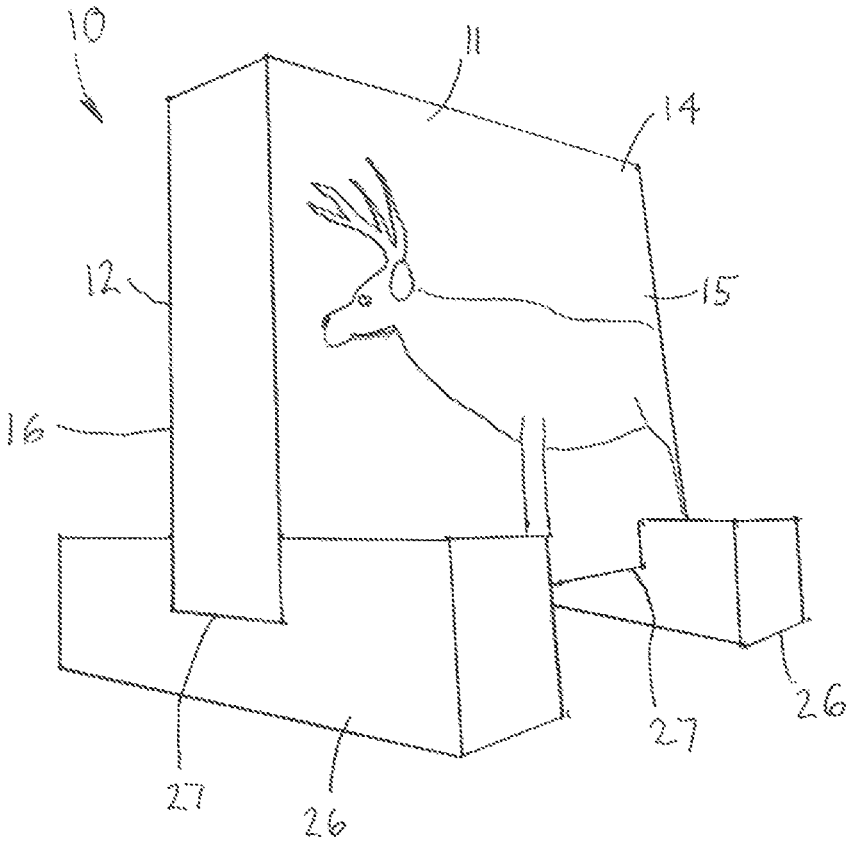
FIG. 1 is a perspective view of a first side of a target usable for practice with shafted projectiles such as arrows and bolts
Figure 2:
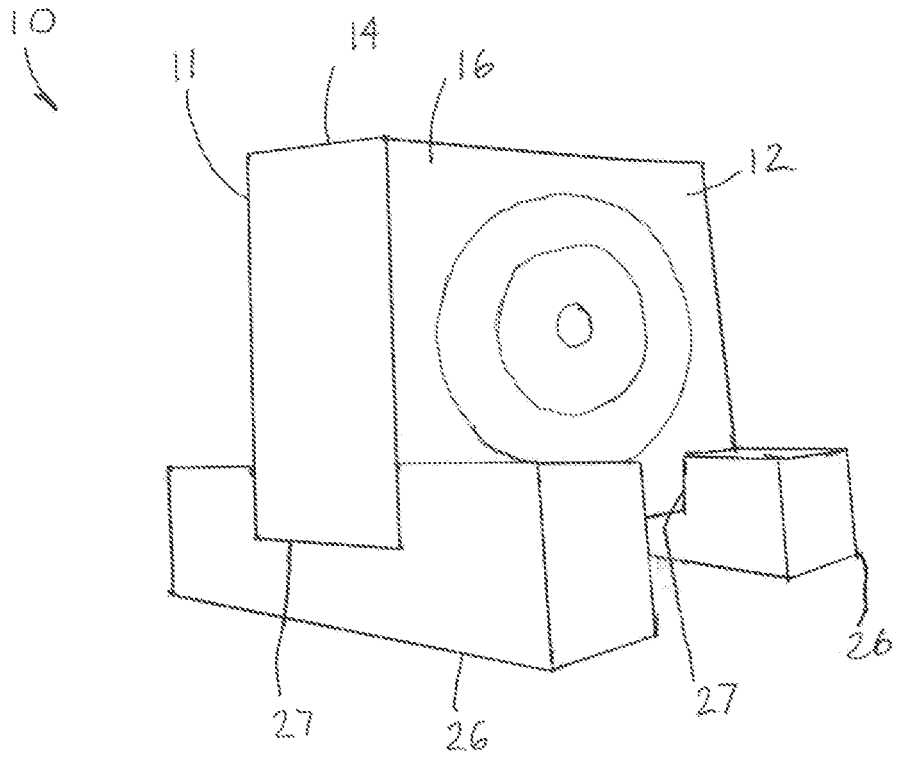
FIG. 2 is a perspective view of a second side of the target, which may have a different target pattern.
Figure 3:
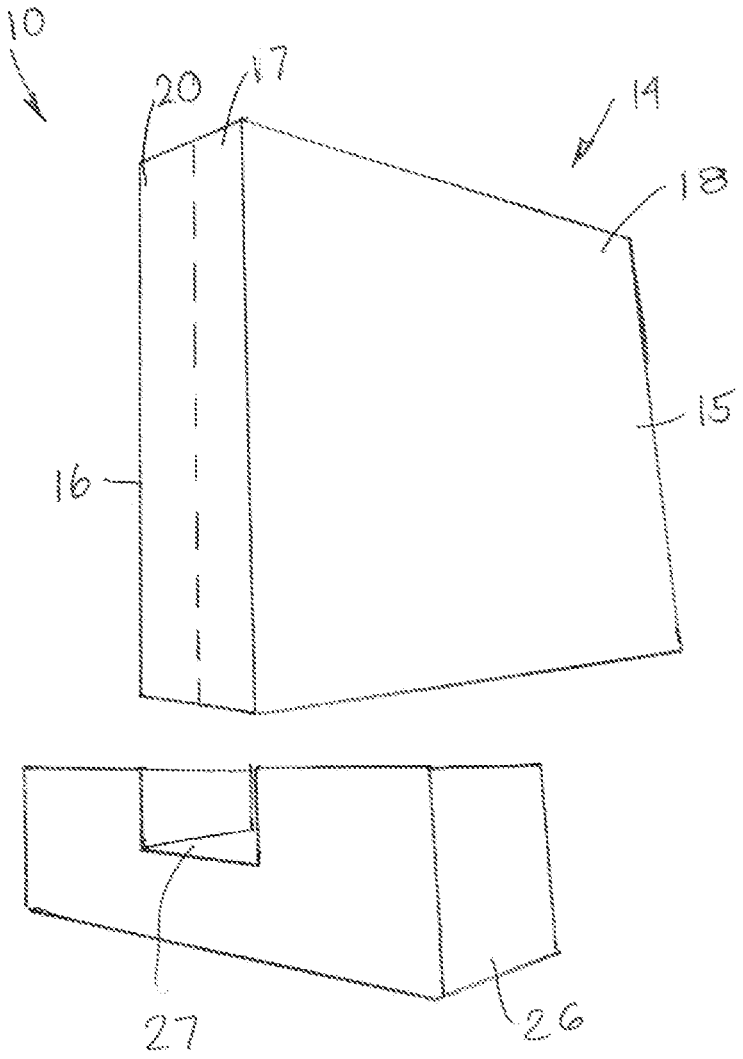
FIG. 3 is an exploded perspective view of the target showing a main body and separable base.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

The invention relates to an improved target construction of a portable target 10 as shown in FIGS. 1-6, which said target 10 preferably includes a target face 11, 12 on both sides of the target body or main body 14. The inventive target 10 has an improved construction comprising at least one target face 11, 12, and preferably both target faces 11 and 12 disposed on the opposite side of the target body 14. Further, the target faces 11 and 12 preferably are formed as high definition face layers 15 and 16 on both sides of the target 10, which define suitable targeting points for the shooting of arrows or other low velocity arrows thereat. In addition to providing high definition visual targets, the inventive target 10 also has the ability to stop arrows or bolts shot out of compound bows, crossbows and traditional bows or other similar devices.

The arrows and bolts are types of shafted projectiles that are shot at relatively low velocities with low energy in comparison to bullet-like projectiles fired using explosive combustion of gunpowder and the like. The inventive target 10 is primarily directed to lower energy projectiles that can be stopped with the selected materials of the target body 14 and puncture resistant materials provided therein. These types of projectiles generally have a nose or tip on an elongate shaft and are projected by bows and/or crossbows at a relatively low energy in comparison to bullets, which are explosively driven at a high energy. These shafted projectiles can be fired at different velocities depending upon the equipment being used, which may include bows, whether compound bows or long bows, and cross bows or any other similar equipment for shooting these types of projectiles. When fired at a practice target, such shafted projectiles preferably only penetrate partially into the target with the tail end of the shaft projecting from the target face for easy removal. While the following description may reference arrows, it will be understood that other shafted projectiles or low velocity projectiles might also be used with the inventive target 10.

The inventive target 10 comprises the high definition print or face layer 15, 16 preferably formed of vinyl or other comparable material on opposite sides of the main body 14. The target 10 further comprises one or a first target layer 17 formed of 4.5" thick 2 lb. density polyethylene foam and provided with a smooth skin layer 18 that is layered preferably on at least the exposed, exterior face surfaces of the first target layer 17 for better vinyl adhesion and a more attractive target face on the exposed surfaces of the target 10. The face layer 16 is applied to this target layer 17. The 4.5" thickness of foam of the target layer 17 offers sufficient rigidity and stability that allows the arrow to penetrate into the foam and keeps it from falling to the ground when the arrow punctures and embeds itself in the target layer 17. It will be understood that other types of material may be selected that would allow the arrow or other projectile to puncture the target material and be embedded therein.

The middle layer section 10A of the target 10 comprises at least one and preferably two interior layers or sheets 19 of a puncture resistant fabric preferably formed of ultra-high-molecular-weight polyethylene (UHMWPE), which are sandwiched between the first target layer 17 and a second target layer 20 that forms the opposite side of the main body 11. The interior layers 19 lie in face-to-face relation and this fabric is very lightweight, durable and designed to resist puncture such as by conventional arrows piercing through either of the target layers 17 or 20. The interior layers 19 preferably extend along an interface that extends long a central plane.

Figure 4:
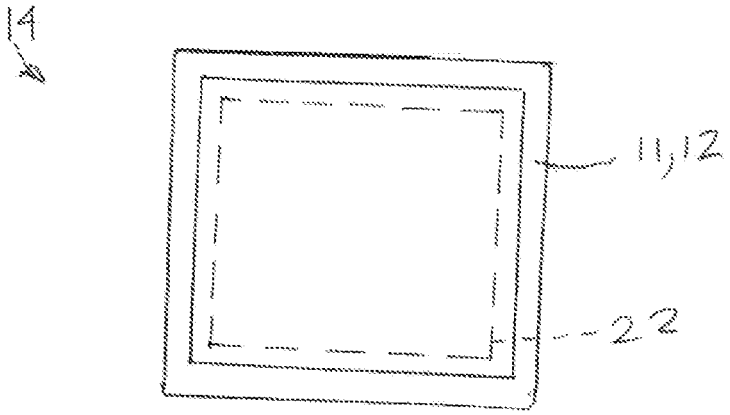
FIG. 4 is a front facing view of the main body.
Figure 5:
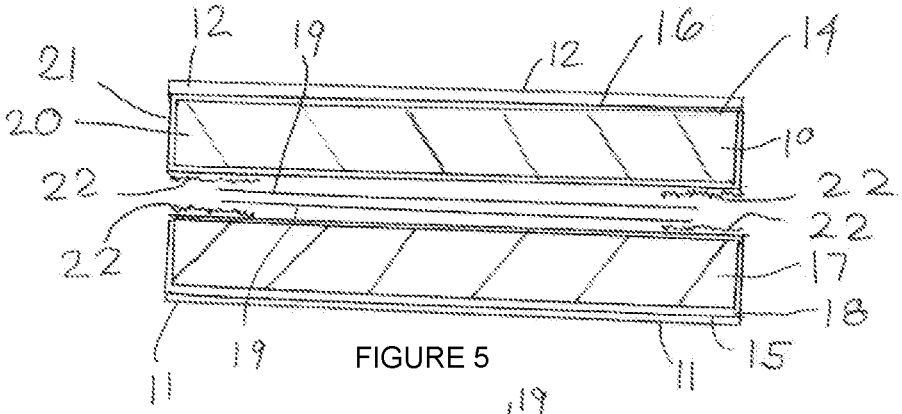
FIG. 5 is a side cross sectional view of the main body.

The second target layer 20 is formed similar to the target layer 17 in that it is formed of a 4.5" thick 2 lb. density polyethylene foam with the same smooth skin layer 21 on the exterior exposed surfaces thereof and a high definition vinyl print forming the other target face layer 16. Referring to FIGS. 4 and 5, the two foam layers 17 and 20 are stacked in face-to-face relation and secured together such as by being adhered together by using contact cement, adhesive or other bonding material 22 only around the outer edge or perimeter as indicated in phantom outline in FIG. 4. The bonding material 22 essentially is sandwiched between opposite interior faces of the target layers 17 and 20 when stacked together. The widthwise depth of this band of bonding material 22 depends on the size of the target 10 but typically is between 4-10 inches measured widthwise, which is a fraction of the entire width of the target layers 17 and 20. This is done so that the puncture resistant material of each interior layer 19 is not adhered to the foam target layers 17 and 20 except about the perimeter of the target layers 17 and 20 and the interior layers 19.

As examples, the interior layer dimensions may be dimensioned as follows: for a 48"×48" target layer 17 or 20, each interior layer 19 measures 39"×39"; for a 36"×36" target layer 17 or 20, the interior layer measures 29"×29"; and for a 24"×24" target layer 17 or 20, the interior layer 19 may measure 19"×19". FIGS. 4 and 5 illustrate these general dimensions with it being understood that the relative dimensions may be made any size.

As such, the interior layers 19 are only secured or bonded to the target layers 17 and 20 in the region of the perimeter and preferably there is no bonding of the central area of the interior layers 19 located interiorly of the perimetral bands of bonding material 22. Basically, this central area is sandwiched and pressed between the two target layers 17 and 20 that are bonded about the perimeters, but the central area is not secured or bonded in place so that it can flex and stretch in response to arrow strikes. As such, the interior layers 19 of sheet material have peripheral portions that are secured between the target layers 17 and 20 while the central areas of the interior layers 19 preferably are unsecured to the target layers 17 and 20. Therefore, each sheet of an interior layer 19 has an unsecured central portion and secured peripheral portions, wherein the central portion can stretch or slide along the interface between the target layers 17 and 20.

Figure 6:
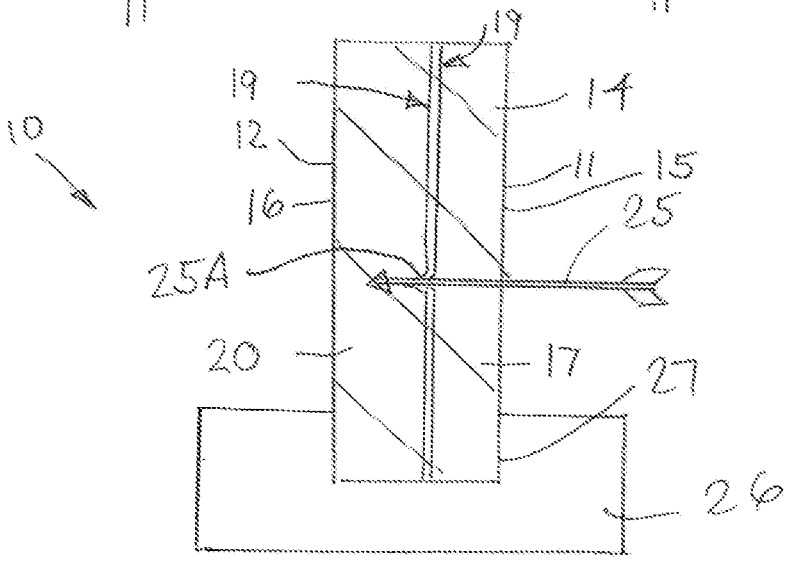
FIG. 6 is a side cross sectional view of the target with a shafted projectile embedded therein and the interior layer surrounding the projectile tip.

This allows unsecured central portions of the interior layers 19 to stretch and catch the arrow 25 as generally illustrated in FIG. 6, wherein the interior layers 19 are shown stretched and flexed next to the arrow puncture 25A. Preferably, the arrow 25 is not able to puncture through the interior layers 19, and instead can stretch along the interface and deform around the arrow tip, even if it penetrates partially into the back side target layer 20. However, if the interior layer material 19 was otherwise covered with contact cement or adhesive throughout the entire central portion and the peripheral portions, it would become hard and stiff, which would not allow the material to stretch and deform when catching the arrow 25. Therefore, the inventive target design is made very effective since the arrows 25 that are being shot at the target 10 on the side of foam target face 11 actually pin the interior layer material of the interior layers 19 into the foam of the opposing target layer 20, keeping the material of the interior layer 19 from settling due to gravity even after the arrow 25 is removed. When another arrow is caught by the interior layers 19, the interior layers 19 again deform and stretch in the area of the latest arrow strike, while pulling and flattening the interior layers 19 in the area(s) of prior strikes. This occurs no matte matter if the arrow is shot from the side of the target layer 17 or the target layer 20.

As noted, the interior layer material is formed of a particular puncture resistant material, which impedes the arrow 25 as it travels through the foam material of the target layers 17 and 20. This interior layer material has sufficient puncture resistance to dissipate the kinetic force of the arrow 25 to a level that preferably prevents piercing of the interior layers 19 and permits only limited penetration into the back target layer 20 through a partial thickness thereof so as to prevent the arrow from completely penetrating the main body 14 as seen in FIG. 6. Since the central area of the interior layers 19 are not adhered and may have some stretchability, this deformation of the interior layers 19 allows the interior layers 19 to deform and form a deformed portion 19A that reduces the kinetic energy of the arrow 25 acting transverse to the plane of the interior layers 19. As noted, the interior layers 19 are effective from either side of the target 10.

The feet portions 26 of the inventive targets are very simple yet unique, in that they are made of the same foam material as the target layers 17 and 20 and have a similar vinyl surface layer or other similar material. The feet portions 26 include upward opening seats or pockets 27, which tight fittingly receive the main body 14 therein. As such, the feet portions 26 and main body 14 are relatively rigid and immovable relative to each when assembled together, but may be disassembled for transport. The feet portions 26 are very effective in keeping the target 10 stationary and if a shooter should miss their intended target and the arrow 25 hits the feet 26, the arrow 25 does not hurt the target 10, the target feet 26 or the arrow 25.

Generally, the interior layer material of the interior layers 19 is not visible on the outside of the target 10, but is shown in these examples for a better visual understanding of the target 10. Notably, after the respective perimeters of the target layers 17 and 20 and interior layers 19 are bonded together by the bonding material 22, the outer skin layers 18 and 21 are applied to the main body 14, which covers the seam between the target layers 17 and 20 and any bonding material 22 that might be visible in this area. Thereafter, the target faces 11 and 12 can be adhered to the opposite side faces of the main body 14. The target faces 11 and 12 can be provided with any high definition print such as the animal illustration of FIG. 1, or the circular target pattern of FIG. 2.

As noted above, the target faces 11 and 12 preferably are formed as high definition face layers 15 and 16 on both sides of the target 10, which define suitable targeting points for the shooting of arrows or other low velocity arrows thereat. The face layers 15 and 16 are formed with high resolution printing for a true life like visual experience, enabling hunters to simulate what they might see in nature. The face layers 15 and 16 are removably laid over the target layers 17 and 20 and are also replaceable to extend the life of the target 10 itself. These face layers 15 and 16 preferably are printed on a durable vinyl with an adhesion back that allows for replaceable mounting over the face surfaces of the target layers 17 and 20.

It will be understood that the target layers 17 and 20 preferably are each formed as a single block of foam and the middle layer section 10A generally lies in the central plane lying halfway through the thickness of the target 10. This provides for a light-weight target 10 that is able to prevent full target penetration at a fraction of the weight of a larger, heavier target that would be required to prevent full penetration without the interior layers 19. However, the individual target layers 17 and 20 may also comprise two or more sub-layers of foam or other suitable material that may be punctured by the arrow or other projectile before reaching the interior layers 19.

With respect to the material selected for the target layers 17 and 20, the foam material permits penetration by the projectile while generally preventing damage thereto. Typically, each of the target layers 17 and 20 would dissipate a fraction of the projectile's kinetic energy, such that, by themselves, the target layers 17 and 20 might allow a projectile to continue through and exit through the back target face. However, each interior layer 19 is puncture resistant and would dissipate additional kinetic energy per layer to dissipate the kinetic energy before the projectile could pierce the interior layers 19 and exit the back target face. Preferably, the combination of one target layer 17 or 20 being hit by the projectile and the one or more interior layers 19 would efficiently dissipate all or most of the kinetic energy of the projectile to greatly reduce or minimize the penetration past the interior layers 19 into the other target layer 17 or 20.

While the inventive target 10 is illustrated with two target layers 17 and 20 and one or more interior layers 19 sandwiched between each adjacent pair of target layers 17 and 20, it is understood that additional target layers and interior layers may be stacked in combination with the existing target layers 17,20 and interior layers 19 to form a thicker target 10 or a target 10 that has the same thickness but several alternating sections of target and interior layers. For example, one target layer 17 might be formed of multiple thinner target layers stacked with one or more interior layers between each adjacent pair of the thinner target layers.

Figure 7:
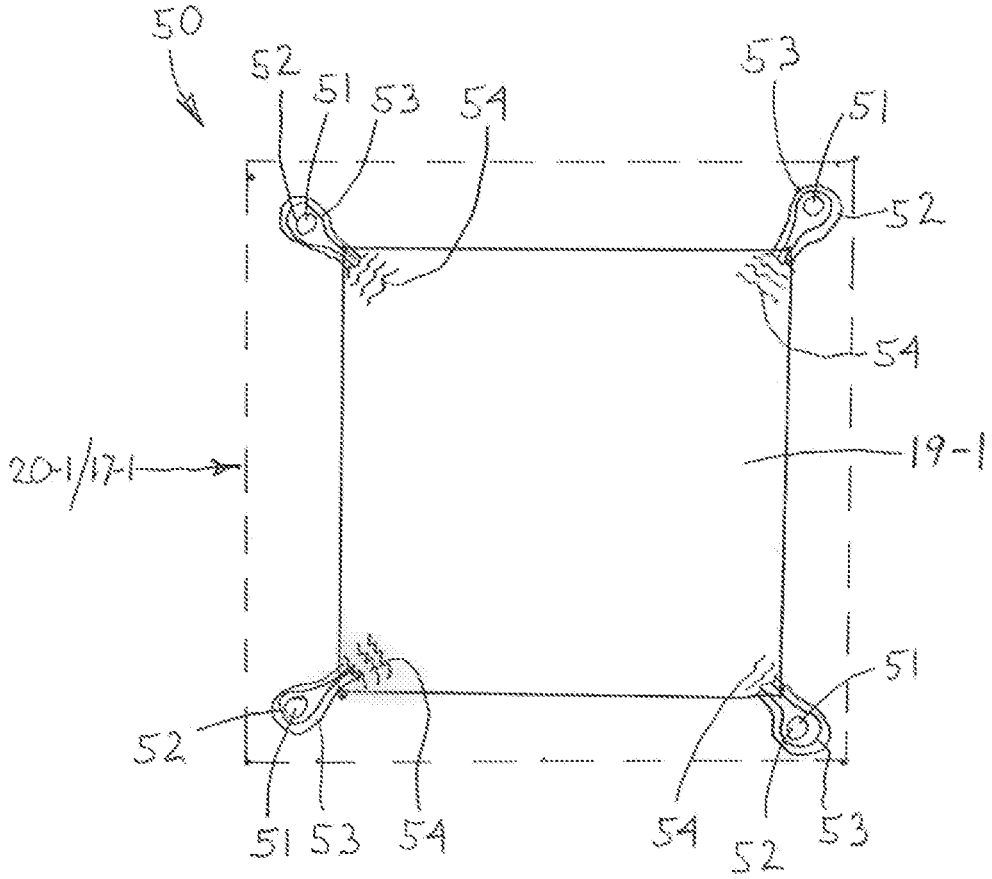
FIG. 7 is a front facing view of the main body of second embodiment of the target.

Referring to FIG. 7, a second embodiment of the invention is disclosed wherein an alternate target 50 may be made up of the same component parts as target 10 except that, instead of gluing the foam of the first and second target layers 16 and 17 together, modified target layers 17-1/20-1 would be provided which are mechanically and removable joined together with one or more interior layers 19-1 sandwiched therebetween so that all parts would be replaceable. The following description uses common numerals for common component parts with the suffix "−1" included to indicate that the parts are modified. As such, the following description focuses upon the modifications and differences in such parts. It will be understood that the target 50 functions the same as target 10.

Preferably, the target layers 17-1/20-1 would be joined by pin-like connectors or anchors 51 provided at least in the corners, wherein the connector or anchor pins 51 extend through aligned corner bores 52 provided in both of the target layers 17-1/20-1. The pins 51 can be dowels that frictionally engage with the bores 52, although they may also be provided as different forms of connectors such as threaded bolts or other fastener constructions to allow removable separation of the target layers 17-1/20-1 such as for repair or replacement of any of the target layers 17-1/20-1 or interior layer(s) 19-1.

Preferably, there are two superimposed interior layers 19-1, which are joined to edge connectors 53. The edge connectors 53 are preferably provided in the corners and are configured to engage the connector pins 51 as shown. For example, the edge connectors 53 may be formed as looped anchor straps that are stitched to the interior layers 19-1 at locations 54 and in turn fit about the connector pins 51 to hold the interior layers 19-1 in a stretched, flat condition. The edge connectors 53 may be somewhat loose as shown or may be taut when connected to the connector pins 53 to tightly stretch the interior layer(s) 19-1 face wise across the face thereof when the interior layers 19-1 are sandwiched between the target layers 17-1/20-1. In this manner, each interior layer 19-1 is formed of puncture resistant material as described above. Here again, the interior layers 19-1 are only secured about the perimeter of the target layers 17-1 and 20-1 and the interior layers 19-1 so that the target 50 functions like the target 10 described above. Like each interior layer 19, each interior layer 19-1 still has the interior area located inwardly of the perimeter disconnected from the target layers 17-1/20-1.

As described in the prior description of interior layer 19, the interior layer material is formed of a particular puncture resistant material, which impedes the arrow 25 as it travels through the foam material of the target layers 17-1 and 20-1. This interior layer materials has sufficient puncture resistance to reduce the kinetic force of the arrow 25 to a level that prevents piercing of the interior layers 19-1 and, as the interior layers 19-1 deform with the arrow tip, only limited penetration of the back target layer 20-1 through a particle thickness thereof so as to prevent the arrow from completely penetrating the target 50 similar to that seen in FIG. 6. Since the central area of the interior layers 19-1 are not adhered and may have some stretchability, this deformation of the interior layers 19-1 may also help reduce the kinetic energy of the arrow 25 acting transverse to the plane of the interior layers 19-1.

In this second embodiment, the target 50 has replaceable parts, which is particularly advantageous for high volume shooting conditions such as at archery ranges.

Referring to FIGS. 8-12, a third embodiment of the inventive target is illustrated and identified by reference numeral 70. The following description uses common numerals for common component parts with the suffix "−2" included to indicate that the parts are modified. As such, the following description focuses upon the modifications and differences in such parts.

The alternate target 70 may be made up of the same component parts as target 10 except that instead of securing the edge portions of the interior layers 19-2 with adhesive, the edge portions 71,72 are secured with a securing formation, preferably formed as an elongate groove 73,74 in which the edge portions 71,72 are embedded or inserted. These edge portions 71,72 may also be secured with supplemental adhesive provided within the grooves 73, 74 so that the edge portions 71,72 are gripped within and adhered to the interior of the grooves 73,74.

It will be understood that the target 70 functions the same as target 10. However, the interior faces 75,76 are grooved, machined or sliced to form the grooves 73,74. The grooves 73,74 may be formed so as to be continuous and have a general rectangular shape having truncated corners 73A, 74A. Since the interior layers 19-2 are generally square or rectangular sections of fabric, the truncated corners 73A, 74A better accommodate receipt of material at the fabric corners.

It will be understood that the target 70 functions the same as target 10. However, the interior faces 75,76 are grooved, machined or sliced to form the grooves 73,74. The grooves 73,74 may be formed so as to be continuous and have a general rectangular shape having truncated corners 75,76. Since the interior layers 19-2 are generally square or rectangular sections of fabric, the truncated corners 75,76 better accommodate receipt of material at the fabric corners.

Figure 8:
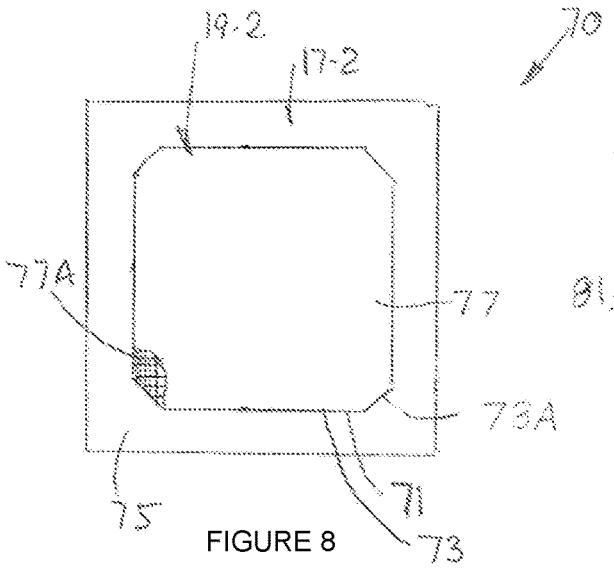
FIG. 8 is a front view is a front facing view of the interior of a first target layer in a third embodiment of the invention.
Figure 9:
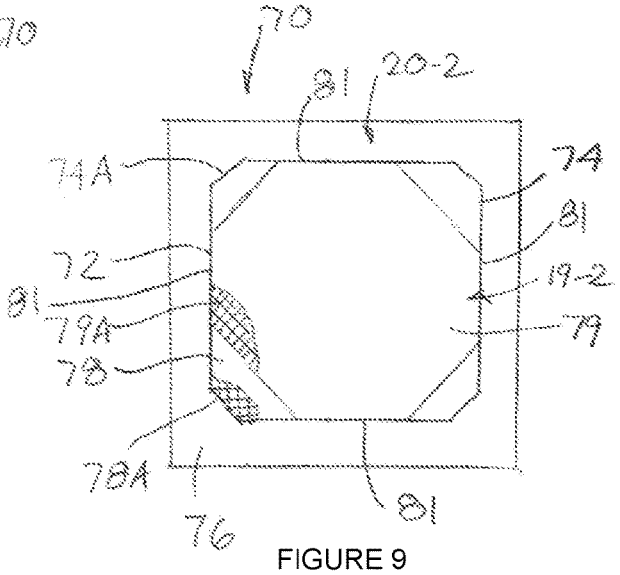
FIG. 9 is a front view is a front facing view of the interior of a second target layer in a third embodiment of the invention.
Figure 10:
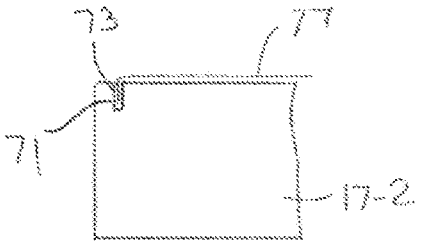
FIG. 10 is a partial cross sectional view of the first target layer of FIG. 8.
Figure 11:
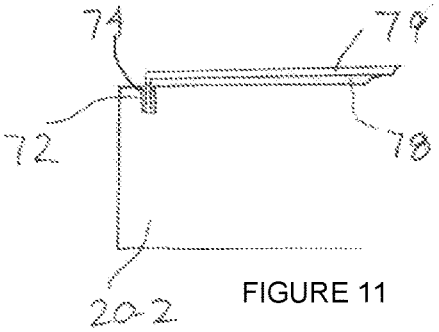
FIG. 11 is a partial cross sectional view of the second target layer of FIG. 9.

In FIG. 8, the target layer 17-2 generally has one interior layer 19-2 shown as interior layer 77. As diagrammatically shown, the interior layer 77 typically is a woven fabric, which can have a particular weave such as the bi-directional weave shown at 77A. The target layer 20-2 also has two interior layers 19-2 shown as interior layers 78 and 79. Each interior layer 78 and 79 has a respective weave that also may be bi-directional as shown at 78A and 79A. To further improve performance and resist puncturing, the weaves may be aligned or in this case, may be oriented transverse as seen on target layer 20-2. In this case, the interior layer 78 is oriented with the weave generally parallel to the side edges of the target layer 20-2. The other interior layer 79 is oriented with its respective weave 79A transverse or at an angle relative to the adjacent weave 78A. As illustrated, the interior layer 79 is laid at a 45 degree angle relative to the interior layer 78 and is secured in place by tucking or embedding the corners 81 into the groove 72. This provides an improved securement of the interior layers 77, 78 and 79 to their respective target layers 17-2 and 20-2.

It will be understood that some fabrics may be non-wovens. For both woven and non-woven fabrics, the constructions may provide performance characteristics such as tensile strength that might differ in different fabric directions. As such, the foregoing discussion of weave patterns also applies to performance characteristics, wherein the performance characteristics of a particular fabric may be oriented transversely in the adjacent interior layers 77, 78 and 79 to improve resistance to puncturing.

Figure 12:
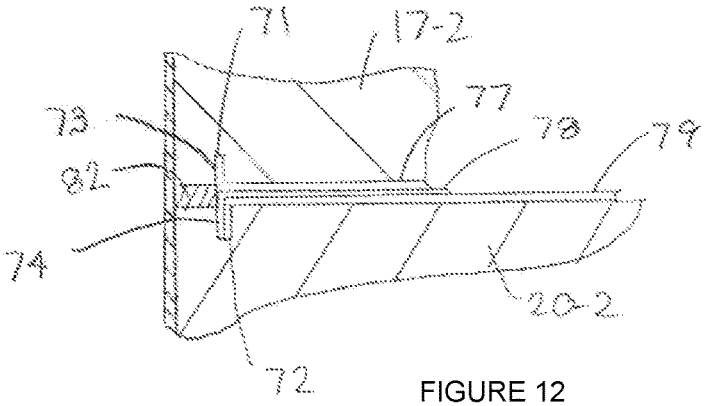
FIG. 12 is an enlarged cross sectional view of the first and second target layers joined together in facing relation.

Preferably, the target layers 17-2/20-2 would be joined in face-to-face relation by adhesive 82 that primarily is provided over their respective peripheries outside of the grooves 71, 72 as seen in FIG. 12. The adhesive 82 bonds the target layers 17-2 and 20-2 together and also helps fill the space therebetween, which space might increase when the number of interior layers 19-2 is increased.

In this manner, each interior layer 19-2 (77, 78 and 79) is formed of puncture resistant material as described above. Here again, the interior layers 19-2 are only secured about the perimeter of the target layers 17-2 and 20-2 and the interior layers 19-2 so that the target 70 functions like the target 10 described above. Like each interior layer 19, each interior layer 19-2 still has the unsecured central or interior area located inwardly of the secured perimeter portions, wherein the unsecured central areas can deform in the central plane between the target layers 17-2 and 20-2 and thereby dissipate kinetic energy from a projectile without puncturing.

As described in the prior description of interior layer 19, the interior layer material for layers 77, 78 and 79 is formed of a particular puncture resistant material, which impedes the arrow 25 as it travels through the foam material of the target layers 17-2 and 20-2. This interior layer material has sufficient puncture resistance to reduce the kinetic force of the arrow 25 to a level that prevents piercing of the interior layers 19-2 and allows only limited penetration of the back target layer 20-2 through a partial thickness thereof so as to prevent the arrow from completely penetrating the target 70 similar to that seen in FIG. 6. Since the unsecured central areas of the interior layers 19-2 are not adhered and may have some stretchability, this deformation of the interior layers 19-2 along the central plane may also help reduce the kinetic energy of the arrow 25 acting transverse to the plane of the interior layers 19-2.

As noted above, the number of interior layers 19-2 can vary between each adjacent pair of target layers 17-2, 20-2. In particular, each interior layer 19-2 has a puncture resistance which will dissipate a magnitude of kinetic energy in the arrow or other projectile. Since archery equipment can shoot arrows at different velocities and with different energy, the number of interior layers 19-2 can vary depending upon the expected velocity of the arrow. For higher energy arrows, additional layers can be provided. For example, the target layer 17-2 may include a second layer like interior layer 79 so that each of the target layers 17-2 is provided with two layers of puncture resistant fabric and the target 70 has four total interior layers 19-2. Or the second target layer 20-2 might only have one fabric layer so that the target 70 has only two total interior layers 19-2. Further, since there are multiple interior layers 19-2, there may be frictional sliding between the fabric faces that also helps to dissipate kinetic energy. This allows the stopping capacity of the target 70 to be varied according to the particular archery equipment being used.

Although particular preferred embodiments of the invention have been disclosed in detail for illustrative purposes, it will be recognized that variations or modifications of the disclosed apparatus, including the rearrangement of parts, lie within the scope of the present invention.

What is claimed:

1. A target having a layered construction comprising:

a main body having opposite first and second target faces formed with one or more target patterns, said main body comprising at least first and second target layers which have respective interior target faces disposed in facing relation with said first and second target layers being joined in facing relation to form said main body, said first and second target layers being formed as rigid blocks each having a respective layer thickness forming a fraction of a total thickness of said main body and said first and second target layers further being disposed in said facing relation to form an interface defining a central plane between said interior target faces of said first and second target layers; and a middle layer section being disposed in said central plane between said interior target faces of said first and second target layers and comprising a plurality of interior layers formed of flexible, puncture resistant sheets disposed in face-to-face relation, each of said interior layers comprising peripheral edge portions which surround a central portion wherein each peripheral edge portion is continuously or at least partially fixed to the respective interior target face of a respective one of said first and second target layers, each said central portion being unsecured from said respective one of said first and second target layers to permit deformation and stretching of said interior layer within said central plane to resist penetration of a projectile through said interior layer and prevent penetration of said projectile entirely through said main body, each of said puncture resistant sheets being formed of a fabric, and each of said interior target faces having a groove formed therein with said fabric in the region of said peripheral edge portions being embedded and secured within said groove of the respective interior target face of the respective one of said first and second target layers.

2. The target according to claim 1, wherein said fabric is flexible and resistant to penetration by the projectile.

3. The target according to claim 1, wherein said puncture resistant sheet of each said interior layer is formed of said fabric wherein said fabric has a bi-directional weave, and one said interior layer has said bi-directional weave oriented transversely at an angle relative to said bi-directional weave of an adjacent said interior layer.

4. The target according to claim 3, wherein said angle is 45 degrees.

5. The target according to claim 1, wherein said central portion of each said interior layer is sandwiched in the central plane between said interior target faces of said first and second target layers so as to be confined within said central plane and be stretchable in a planar direction extending across said central plane between said first and second target layers.

6. The target according to claim 1, wherein said peripheral edge portions are secured in place within said central plane to prevent movement thereof within said central plane.

7. A target having a layered construction comprising:

a main body having opposite first and second target faces formed with target patterns, said main body comprising at least first and second target layers which have interior target faces disposed in facing relation with said first and second target layers to form an interface between said first and second target layers, wherein said first and second target layers are joined in facing relation to form said main body, said first and second target layers being formed as rigid blocks each having a respective layer thickness forming a fraction of a total thickness of said main body and said first and second target layers being disposed in said facing relation with said interface formed therebetween to define a central plane between said interior target faces of said first and second target layers; and a middle layer section being disposed in said central plane between said interior target faces of said first and second target layers and comprising a plurality of interior layers formed of flexible, puncture resistant sheets disposed in face-to-face relation, each of said interior layers comprising peripheral edge portions which surround a central portion wherein each peripheral edge portion is continuously or at least partially fixed to a respective one of said first and second target layers, each said central portion being unsecured from said respective one of said first and second target layers to permit deformation of said interior layer within said central plane to resist penetration of a projectile through said interior layer and prevent penetration of said projectile entirely through said main body; and each of said first and second target layers having said respective interior target faces disposed in face to face relation to define said interface therebetween extending along said central plane, at least one of said interior target faces having said peripheral edge portions of at least one of said interior layers secured thereto to prevent movement of said peripheral edge portions within said central plane while permitting stretching of said central portion of said at least one interior layer along said interface, each of said puncture resistant sheets being formed of a fabric, and said at least one of said interior target faces having a groove formed therein and said fabric in the region of said peripheral edge portions being embedded within said groove.

8. The target according to claim 7, wherein said fabric is flexible and resistant to penetration by the projectile.

9. The target according to claim 7, wherein said puncture resistant sheet of each said interior layer is formed of said fabric, wherein said fabric has a bi-directional weave, and one said interior layer has said bi-directional weave oriented transversely at an angle to said bi-directional weave of an adjacent said interior layer.

10. The target according to claim 9, wherein said angle is 45 degrees.

11. The target according to claim 7, wherein said central portion of each said interior layer is sandwiched in the central plane between said first and second target layers so as to be confined within said central plane by said first and second target layers and be stretchable through said central plane between said first and second target layers.

12. A target having a layered construction comprising:

a main body having opposite first and second target faces formed with target patterns, said main body comprising a plurality of target layers which are each formed as rigid blocks wherein said target layers are joined in facing relation to form said main body with an interface formed between each adjacent pair of said target layers, said target layers comprising at least first and second target layers forming said first and second target faces; and an inner layer section defined at said interface between each said adjacent pair of said target layers and comprising a plurality of interior layers formed of flexible, puncture resistant sheets disposed in face-to-face relation, each of said interior layers comprising peripheral edge portions which surround a central portion wherein each peripheral edge portion is continuously or at least partially fixed to a respective one of said adjacent target layers, each said central portion being unsecured from said adjacent target layers in the region of said interface to permit deformation of said interior layer along said interface to prevent penetration of a projectile through said interior layer and prevent penetration of said projectile entirely through said main body, each of said adjacent target layers having respective interior target faces disposed in face to face relation to define said interface therebetween, at least one of said interior target faces having said peripheral edge portions of at least one of said interior layers secured thereto to prevent movement of said peripheral edge portions along said interface while permitting stretching of said central portion of said interior layer along said interface to stop a projectile, wherein each of said puncture resistant sheets is formed of a fabric, and said at least one of said interior target faces has a groove formed therein with said fabric in the region of said peripheral edge portions being embedded within said groove.

13. The target according to claim 12, wherein said fabric is flexible and resistant to penetration by the projectile.

14. The target according to claim 12, wherein said central portion of each said interior layer is sandwiched in said interface between said adjacent target layers so as to be confined within said interface by said adjacent target layers and be stretchable along said interface between said adjacent target layers.

* * * * *